US007345501B2

(12) United States Patent
Hasegawa et al.

(10) Patent No.: US 7,345,501 B2
(45) Date of Patent: Mar. 18, 2008

(54) ELECTRO-OPTICAL DEVICE, ELECTRONIC APPARATUS, AND MOUNTING STRUCTURE

(75) Inventors: Kenichi Hasegawa, Nagano (JP); Atsunari Tsuda, Nagano (JP)

(73) Assignee: Seiko Epson Corporation (JP)

( * ) Notice: Subject to any disclaimer, the term of this patent is extended or adjusted under 35 U.S.C. 154(b) by 169 days.

(21) Appl. No.: 11/159,701

(22) Filed: Jun. 23, 2005

(65) Prior Publication Data

US 2006/0020656 A1 Jan. 26, 2006

(30) Foreign Application Priority Data

Jul. 23, 2004 (JP) ..... 2004-215320

(51) Int. Cl.
*G01R 31/02* (2006.01)

(52) U.S. Cl. ..... 324/770; 324/158.1

(58) Field of Classification Search ..... None
See application file for complete search history.

(56) References Cited

U.S. PATENT DOCUMENTS

| | | | | |
|---|---|---|---|---|
| 4,730,156 | A * | 3/1988 | Matsuda | 340/653 |
| 5,767,454 | A * | 6/1998 | Goodwin, III | 177/45 |
| 6,218,201 | B1 | 4/2001 | Plangger et al. | |
| 2002/0191140 | A1 | 12/2002 | Eguchi et al. | |
| 2007/0109485 | A1 | 5/2007 | Eguchi et al. | |

FOREIGN PATENT DOCUMENTS

| | | | |
|---|---|---|---|
| CN | 1132052 | A | 10/1996 |
| CN | 1391132 | A | 1/2003 |
| JP | 05-315418 | | 11/1993 |
| JP | 10-207733 | | 8/1998 |
| JP | 10-221407 | | 8/1998 |
| JP | 10-283581 | | 10/1998 |
| JP | 11-038085 | | 2/1999 |
| JP | 2000-235191 | | 8/2000 |
| JP | 2000-276369 | | 10/2000 |
| JP | 2003-057677 | | 2/2003 |
| TW | 00373281 | | 11/1999 |

* cited by examiner

*Primary Examiner*—Ernest Karlsen
(74) *Attorney, Agent, or Firm*—Harness, Dickey & Pierce, P.L.C.

(57) ABSTRACT

An electro-optical device includes a first substrate that holds an electro-optical material, a first IC that is mounted on the first substrate and that has a plurality of first terminals, a plurality of second terminals that are formed on the first substrate to be connected to the plurality of first terminals, respectively, a plurality of wiring lines formed on the first substrate, first connection state diagnostic terminals that are included in the plurality of first terminals and that are used for diagnosing connection states between the first terminals and the second terminals, second connection state diagnostic terminals that are included in the plurality of second terminals and that are connected to the first connection state diagnostic terminals, respectively, a connection state diagnostic unit that is provided in the first IC to diagnose whether the first and second connection state diagnostic terminals are electrically connected to each other, and a connection state diagnosis result output unit that is provided in the first IC and that outputs a diagnosis result obtained by the connection state diagnostic unit.

8 Claims, 8 Drawing Sheets

ELECTRO-OPTICAL DEVICE, ELECTRONIC APPARATUS, AND MOUNTING STRUCTURE

RELATED APPLICATIONS

This application claims priority to Japanese Patent Application No. 2004-215320 filed Jul. 23, 2004 which is hereby expressly incorporated by reference herein in its entirety.

BACKGROUND OF THE INVENTION

1. Technical Field

The present invention relates to an electro-optical device, an electronic apparatus having the same, and a mounting structure in which a member is mounted on a mounting substrate, and more particularly, to a technique of performing the diagnosis of an electro-optical device and a mounting structure.

2. Related Art

In general, in electro-optical devices, such as active matrix liquid crystal devices, a driving IC and a flexible substrate are mounted on an electro-optical device substrate holding an electro-optical material, and each pixel is driven by signals output from the driving IC or signals generated based on the signals output from the driving IC (for example, see Japanese Unexamined Patent Application Publication No. 2003-57677).

Further, an electro-optical device substrate or a flexible substrate has a power supply IC, an EPROM, an IC for driving an LED for a backlight, etc. mounted thereon, in addition to the driving IC. However, when a defect occurs in any one of these ICs, a great deal of labor is required to pinpoint the cause of the defect. Therefore, there has been proposed a technique of allowing an IC to have a self-diagnostic function (for example, see Japanese Unexamined Patent Application Publication No. 5-315418).

In the electro-optical device disclosed in Japanese Unexamined Patent Application Publication No. 2003-57677, when a defect occurs in mounting an IC on a substrate and poor connection is obtained between terminals of the IC and terminals of the substrate, a display defect occurs. However, it is difficult to find such a connection defect even though the IC having the self-diagnostic function is provided, as described in Japanese Unexamined Patent Application Publication No. 5-315418.

In addition, in a case in which a plurality of ICs is mounted on an electro-optical device substrate or a flexible substrate, when each of the plurality of ICs has a self-diagnostic function, it is necessary for each of the plurality of ICs to output self-diagnosis results, which causes the circuit structure to become complicated.

SUMMARY

An advantage of the invention is that it provides an electro-optical device, an electronic apparatus having the electro-optical device, and a mounting structure capable of easily diagnosing a connection state between terminals at a mounting portions when an IC is mounted on a substrate directly or through a wiring substrate.

Another advantage of the invention is that it provides an electro-optical device, an electronic apparatus having the electro-optical device, and a mounting structure capable of easily detecting whether a defect occurs in an IC or a substrate and of outputting the detected result.

According to a first aspect of the invention, there is provided an electro-optical device including a first substrate that holds an electro-optical material, a first IC that is mounted on the first substrate and that has a plurality of first terminals, a plurality of second terminals that are formed on the first substrate to be connect to the plurality of first terminals, a plurality of wiring lines formed on the first substrate, first connection state diagnostic terminals that are included in the plurality of first terminals and that are used for diagnosing connection states between the first terminals and the second terminals, second connection state diagnostic terminals that are included in the plurality of second terminals and that are connected to the first connection state diagnostic terminals, respectively, a connection state diagnostic unit that is provided in the first IC to diagnose whether the first and second connection state diagnostic terminals are electrically connected to each other, and a connection state diagnosis result output unit that is provided in the first IC and that outputs a diagnosis result obtained by the connection state diagnostic unit.

According to the first aspect of the invention, the first connection state diagnostic terminals are included in the plurality of first terminals of the first IC, and the second connection state diagnostic terminals connected to the first connection state diagnostic terminals are included in the plurality of second terminals of the first substrate. For this reason, in a state in which the first IC is mounted on the first substrate, the connection state diagnostic unit determines that good connection is obtained between the second connection state diagnostic terminals and the first connection state diagnostic terminals when the second connection state diagnostic terminals and the first connection state diagnostic terminals are electrically connected to each other, and determines that poor connection is obtained between the second connection state diagnostic terminals and the first connection state diagnostic terminals when the second connection state diagnostic terminals and the first connection state diagnostic terminals are not electrically connected to each other. After that, the diagnosis results are output by the connection state diagnosis result output unit. Therefore, since the mounting state of the first IC with respect to the first substrate can be diagnosed, even though a defect occurs in the electro-optical device, it can be easily determined whether the defect is caused by the mounting of the first IC with respect to the first substrate.

According to a second aspect of the invention, there is provided an electro-optical device including a first substrate that holds an electro-optical material, a wiring substrate that is mounted on the first substrate and that has a plurality of first terminals and a first IC thereon, a plurality of second terminals that are formed on the first substrate to be connected to the plurality of first terminals, a plurality of wiring lines formed on the first substrate, first connection state diagnostic terminals that are included in the plurality of first terminals and that are used for diagnosing connection states between the first terminals and the second terminals, second connection state diagnostic terminals that are included in the plurality of second terminals and that are connected to the first connection state diagnostic terminals, respectively, a connection state diagnostic unit that is provided in the first IC to diagnose whether the first and second connection state diagnostic terminals are electrically connected to each other, and a connection state diagnosis result output unit that is provided in the first IC and that outputs a diagnosis result by the connection state diagnostic unit.

According to the second aspect of the invention, the first connection state diagnostic terminals are included in the plurality of first terminals of the wiring substrate, and the second connection state diagnostic terminals connected to the first connection state diagnostic terminals are included in the plurality of second terminals of the first substrate. For this reason, in a state in which the wiring substrate is mounted on the first substrate, the connection state diagnostic unit determines that good connection is obtained between the second connection state diagnostic terminals and the first connection state diagnostic terminals when the second connection state diagnostic terminals and the first connection state diagnostic terminals are electrically connected to each other, and determines that poor connection is obtained between the second connection state diagnostic terminals and the first connection state diagnostic terminals when the second connection state diagnostic terminals and the first connection state diagnostic terminals are not electrically connected to each other. After that, the diagnosis results are output by the connection state diagnosis result output unit. Therefore, since the mounting state of the wiring substrate with respect to the first substrate can be diagnosed, even though a defect occurs in the electro-optical device, it can be easily determined whether the defect is caused by the mounting of the wiring substrate with respect to the first substrate.

Further, it is preferable that the wiring substrate be a flexible substrate and that the first substrate be a rigid substrate.

According to this aspect, the first connection state diagnostic terminals are composed of pairs of first connection state diagnostic terminals, and the second connection state diagnostic terminals are composed of pairs of second connection state diagnostic terminals. In addition, the second connection state diagnostic terminals are connected to a connection state diagnostic conductive pattern on the first substrate, and the connection state diagnostic unit diagnoses whether the first connection state diagnostic terminals are electrically connected to each other. In this case, the connection state diagnostic unit determines that good connection is obtained between the first terminal and the second terminal when the first connection state diagnostic terminals are electrically connected to each other, and determines that poor connection is obtained between the first terminal and the second terminal when the first connection state diagnostic terminals are not electrically connected to each other. After that, the diagnosis results are output through the connection state diagnosis result output unit. Therefore, since the mounting state of the first IC or wiring substrate with respect to the second substrate can be diagnosed, even though a defect occurs in the electro-optical device, it can be easily determined whether the defect is caused by the mounting of the first IC or wiring substrate with respect to the second substrate.

According to this aspect, the plurality of first terminals include a pair of first substrate crack diagnostic terminals used for diagnosing whether a crack occurs in the first substrate, and the plurality of second terminals include a pair of second substrate diagnostic terminals that are connected to the pair of first substrate crack diagnostic terminals. In addition, the pair of second substrate crack diagnostic terminals is connected to a substrate crack diagnostic conductive pattern extending around an outer periphery of the first substrate, and the first IC includes a substrate crack diagnostic unit that diagnoses whether the first substrate crack diagnostic terminals are electrically connected to each other and a substrate crack diagnosis result output unit that outputs a diagnosis result obtained by the substrate crack diagnostic unit. In this case, when a crack occurs in the first substrate and the substrate crack diagnostic conductive pattern is broken, the first substrate crack diagnostic terminals are not electrically connected to each other. Therefore, when the first substrate crack diagnostic terminals are electrically connected to each other, the substrate crack diagnostic unit diagnoses that a substrate crack does not occur. On the other hand, when the first substrate crack diagnostic terminals are not electrically connected to each other, the substrate crack diagnostic unit diagnoses that a substrate crack occurs. After that, the diagnosis result is output by the substrate crack diagnosis result output unit. Therefore, even though a defect occurs in an electro-optical device, it can be easily determined whether the defect is caused by the crack of the first substrate.

According to this aspect, when the electro-optical device is a liquid crystal device, the electro-optical device further includes a second substrate opposite to the first substrate with an electro-optical material interposed therebetween.

In this case, each of the first and second substrates has intersubstrate connecting terminals, and the first and second substrates are bonded to each other with an intersubstrate conductive material interposed therebetween, so that the intersubstrate connecting terminals respectively formed on the first and second substrates are electrically connected to each other. In addition, the pair of second substrate crack diagnostic terminals is formed only on the first substrate, and the substrate crack diagnostic conductive patterns are respectively formed on the first substrate and the second substrate. Further, the substrate crack diagnostic conductive patterns respectively formed on the first and second substrates are electrically connected to each other in series between the pair of second substrate crack diagnostic terminals by the intersubstrate conductive material and the intersubstrate connecting terminals.

According to this aspect, one or more second ICs are mounted on the first substrate or the second substrate, and the first IC is supplied with information as to whether the second ICs are normally operated from the second ICs. In addition, the information or the diagnosis results of the second ICs based on the information are output from the first IC. In this case, even though a plurality of ICs is mounted, it is not necessary that a self-diagnostic function be added to each of the plurality of ICs and that the diagnosis result be not output from each of the plurality of ICs. Therefore, it is possible to diagnose the plurality of ICs with a simple circuit structure.

According to this aspect, it is preferable that the first IC have a rectangular shape and that the first connection state diagnostic terminals be respectively provided at four corners of the first IC. When a connection state is diagnosed at each of the four corners, it is possible to reliably diagnose the connection state between the first and second terminals.

The electro-optical device to which the invention is applied is used for portable electronic apparatuses, such as a mobile computer or a cellular phone, or electronic apparatuses, such as a direct-view-type display device or a projection display device.

The invention can be applied to various mounting structures as well as the electro-optical device. That is, according to a third aspect of the invention, there is provided a mounting structure including a first IC having a plurality of first terminals, a first substrate that has a plurality of second terminals connected to the plurality of first terminals thereon and that is mounted with the first IC is mounted, first connection state diagnostic terminals that are included in the plurality of first terminals and that diagnoses connection states between the first terminals and the second terminals, second connection state diagnostic terminals that are included in the plurality of second terminals and that are connected to the first connection state diagnostic terminals, a connection state diagnostic unit that is provided in the first IC to diagnose whether the first and second connection state diagnostic terminals are electrically connected to each other, and a connection state diagnosis result output unit that is provided in the first IC and that outputs a diagnosis result obtained by the connection state diagnostic unit.

According to the third aspect of the invention, the connection state diagnostic unit determines that good connection is obtained between the second connection state diagnostic terminals and the first connection state diagnostic terminals when the second connection state diagnostic terminals and the first connection state diagnostic terminals are electrically connected to each other, and determines that poor connection is obtained between the second connection state diagnostic terminals and the first connection state diagnostic terminals when the second connection state diagnostic terminals and the first connection state diagnostic terminals are not electrically connected to each other. After that, the diagnosis results are output through the connection state diagnosis result output unit. Therefore, since the mounting state of the first IC with respect to the first substrate can be diagnosed, even though a defect occurs in the mounting structure, it can be easily determined whether the defect is caused by the mounting of the first IC with respect to the first substrate.

According to a fourth aspect of the invention, there is provided a mounting structure including a wiring substrate that has a plurality of first terminals and that is mounted with a first IC, a first substrate that has a plurality of second terminals connected to the plurality of first terminals and that is mounted with the wiring substrate, first connection state diagnostic terminals that are included in the plurality of first terminals and that are used for diagnosing connection states between the first terminals and the second terminals, second connection state diagnostic terminals that are included in the plurality of second terminals and that are connected to the first connection state diagnostic terminals, a connection state diagnostic unit that is provided in the first IC to diagnose whether the first and second connection state diagnostic terminals are electrically connected to each other, and a connection state diagnosis result output unit that is provided in the first IC and that outputs the diagnosis result obtained from the connection state diagnostic unit.

According to this aspect, the connection state diagnostic unit determines that good connection is obtained between the second connection state diagnostic terminals and the first connection state diagnostic terminals when the second connection state diagnostic terminals and the first connection state diagnostic terminals are electrically connected to each other, and determines that poor connection is obtained between the second connection state diagnostic terminals and the first connection state diagnostic terminals when the second connection state diagnostic terminals and the first connection state diagnostic terminals are not electrically connected to each other. After that, the diagnosis results are output through the connection state diagnosis result output unit. Therefore, since the mounting state of the wiring substrate with respect to the first substrate can be diagnosed, even though a defect occurs in the mounting structure, it can be easily determined whether the defect is caused by the mounting of the wiring substrate with respect to the first substrate.

BRIEF DESCRIPTION OF THE DRAWINGS

The invention will be described with reference to the accompanying drawings, wherein like numbers reference like elements, and wherein.

DESCRIPTION OF THE EMBODIMENTS

Hereinafter, preferred embodiments of the invention will be described with reference to the accompanying drawings.

First Embodiment

Overall Structure of Electro-Optical Device

Figure 1:
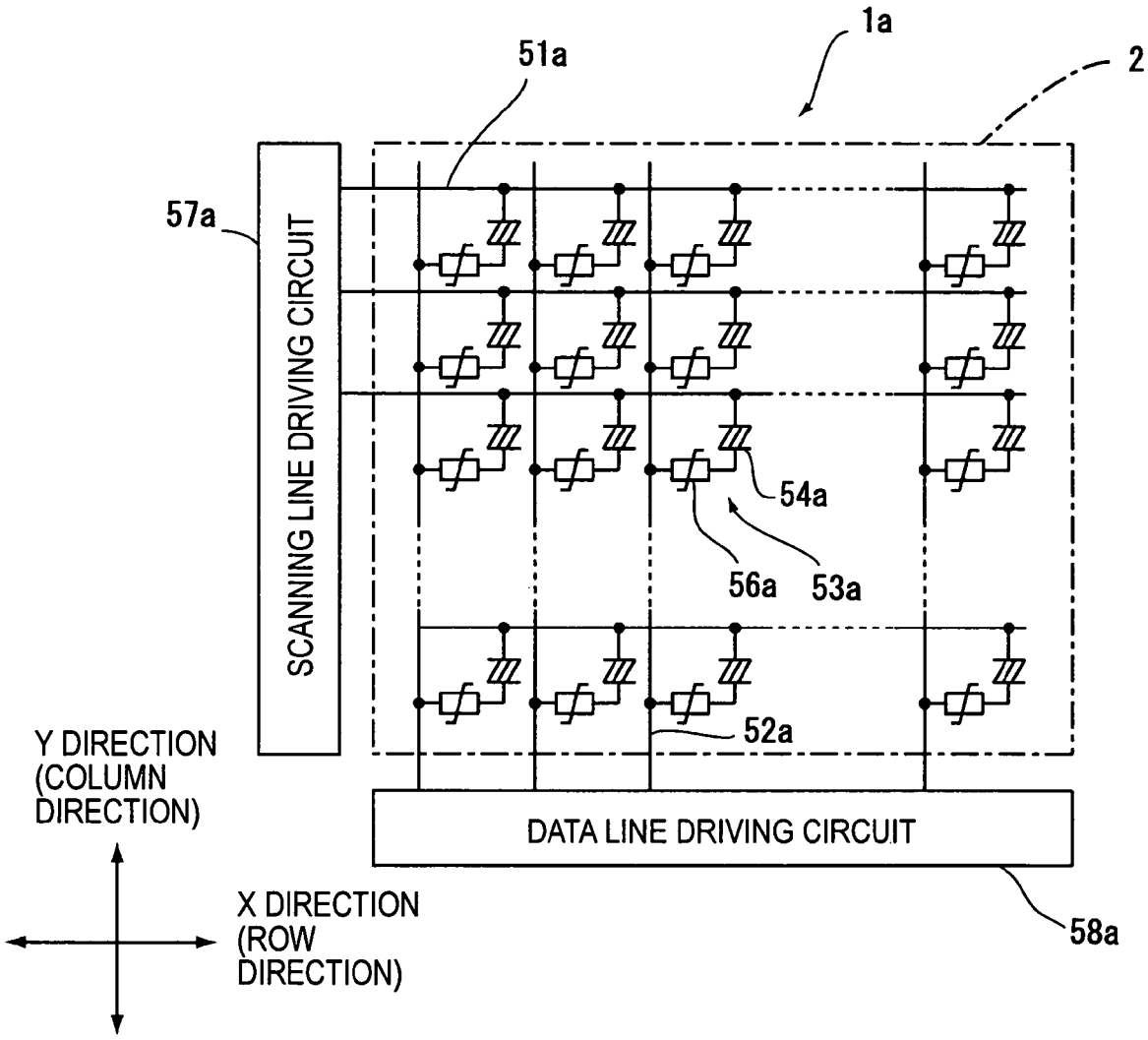
FIG. 1 is a block diagram schematically illustrating the structure of an electro-optical device composed of an active matrix liquid crystal device using TFDs as pixel switching elements.
Figure 2A:
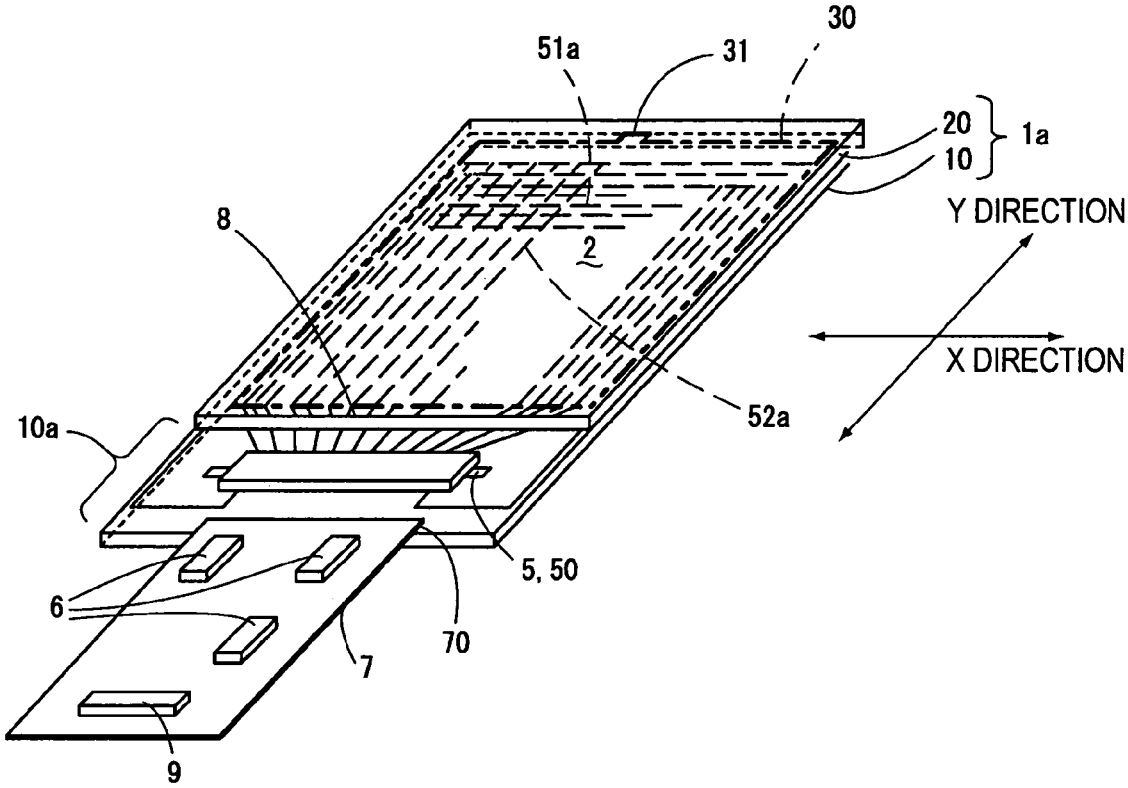
FIG. 2A is a schematic perspective view of the electro-optical device according to the invention, as viewed from a counter substrate.

FIG. 1 is a block diagram illustrating the electrical structure of an electro-optical device. FIG. 2A is a schematic perspective view illustrating an electro-optical device according to an embodiment of the invention, as viewed from a counter substrate, and FIG. 2B is a cross-sectional view taken along the Y direction of the electro-optical device to pass through pixel electrodes.

An electro-optical device 1*a* shown in FIG. 1 is an active matrix liquid crystal device using thin film diodes (TFDs) as pixel switching elements. In an image display region 2 of the electro-optical device 1*a*, when two directions orthogonal to each other are the X direction and the Y direction, a plurality of scanning lines 51*a* extends in the X direction (row direction), and a plurality of data lines 52*a* extends in the Y direction (column direction). Also, in the image display region 2 of the electro-optical device 1*a*, a plurality of pixels 53*a* are formed corresponding to intersections of the scanning lines 51*a* and the data lines 52*a*, and the plurality of pixels 53*a* are arranged in a matrix. In these pixels 53*a*, a liquid crystal layer 54*a* and pixel switching TFDs 56*a* are connected to each other in series. The respective scanning lines 51*a* are driven by a scanning line driving circuit 57*a*, and the respective data lines 52*a* are driven by a data line driving circuit 58*a*.

Figure 2B:
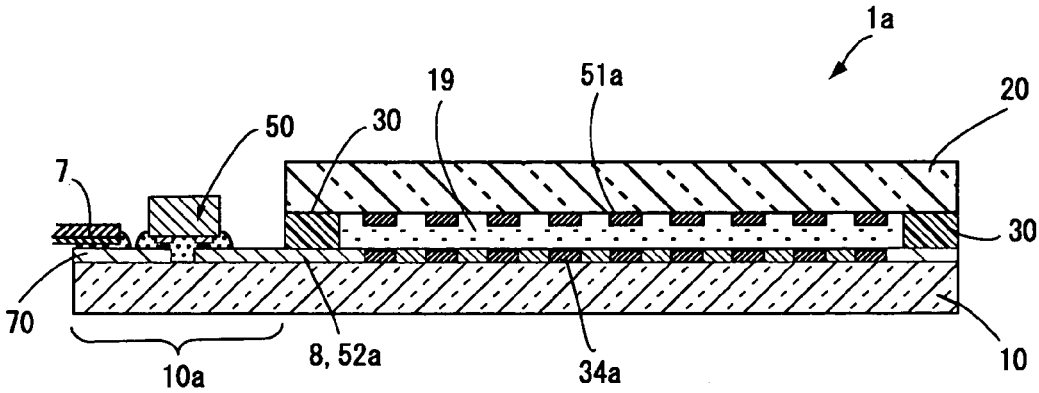
FIG. 2B is a cross-sectional view taken along the Y direction of the electro-optical device to pass through pixel electrodes.

In the structure of the electro-optical device 1*a*, as shown in FIGS. 2A and 2B, an element substrate 10 (an electro-optical device substrate/a first substrate) and a counter substrate 20 (an electro-optical device substrate/a second substrate) are bonded to each other by a sealing member 30, and liquid crystal 19, serving as an electro-optical material, is injected into a region surrounded by the two substrates and the sealing member 30. The sealing member 30 is formed substantially in a rectangular frame shape around an outer periphery of the counter substrate 20, and a portion of the sealing member 30 is opened so that the liquid crystal 19 is injected thereinto. After the liquid crystal 19 is injected, the opened portion is sealed by a sealant 31.

The element substrate 10 and the counter substrate 20 are plate-shaped members made of a transmissive material, such as glass, quartz, or plastic. The plurality of data lines 52*a*, the pixel switching TFDs (not shown), pixel electrodes 34*a*, an alignment film (not shown), etc., are formed on an inner surface (a surface facing the liquid crystal 19) of the element substrate 10. Meanwhile, the plurality of scanning lines 51*a* is formed on an inner surface of the counter substrate 20, and an alignment film (not shown) is formed on the scanning lines 51*a*.

Further, polarizing plates for polarizing incident light, retardation plates for compensating for interference colors, etc., are properly bonded to the outer surfaces of the element substrate 10 and the counter substrate 20, respectively. In addition, when color display is performed, R (red), G (green), and B (blue) filters (not shown) are formed in a predetermined arrangement in regions on the counter substrate 20 opposite to the pixel electrodes 34*a*, and a black matrix (not shown) is formed in regions not opposite to the pixel electrodes 34*a*. Further, on the surface having the color filters and the black matrix thereon, a planarizing layer for planarizing and protecting the surface is coated, and the scanning lines 51*a* are formed on the planarizing layer. However, since the above-mentioned components are not directly related to the invention, the description and illustration thereof will be omitted.

In the electro-optical device 1*a* of the present embodiment, the element substrate 10 has a projecting region 10*a* protruding from one side of the outer periphery of the sealing member 30 in a state in which the element substrate 10 and the counter substrate 20 are bonded to each other by the sealing member 30. Conductive patterns 8 integrated with the data lines 52*a* and other conductive patterns 8 electrically connected to the scanning lines 51*a* by electrical connection between the substrates extend toward the projection region 10*a*. In order to perform electrical connection between the substrates, resin containing a plurality of conductive particles therein is used as the sealing member 30. For example, plastic particles coated with a metallic material, or resin particles having conductivity are used as the conductive particles functioning to electrically connect intersubstrate conductive terminals (end portions of wiring patterns) respectively formed on the element substrate 10 and the counter substrate 20. Therefore, in the present embodiment, a driving IC 5 (a first IC) for respectively outputting image signals and scanning signals to the data lines 52*a* and the scanning lines 51*a* is mounted on only the element substrate 10 in a COG manner, and a flexible substrate 7 (a wiring substrate) is connected to the element substrate 10. That is, an IC mounting region 50 is formed in the projecting region 10*a* of the element substrate, and the driving IC 5 is mounted in the IC mounting region 50. In addition, in the projecting region 10*a* of the element substrate 10, a substrate connecting region 70 is provided at a position closer to a substrate edge 11 than to the IC mounting region 50, and the flexible substrate 7 is connected to the substrate connecting region 70. Further, the flexible substrate 7 has a plurality of auxiliary ICs 6 (second ICs), such as a power supply IC, an EPROM, and an IC for driving an LED for a backlight, mounted thereon. In addition, the flexible substrate 7 has a connector 9 for electrical connection with a main body of an electronic apparatus mounted thereon.

Structure of Connection-State-Diagnostic Function

Figure 3:
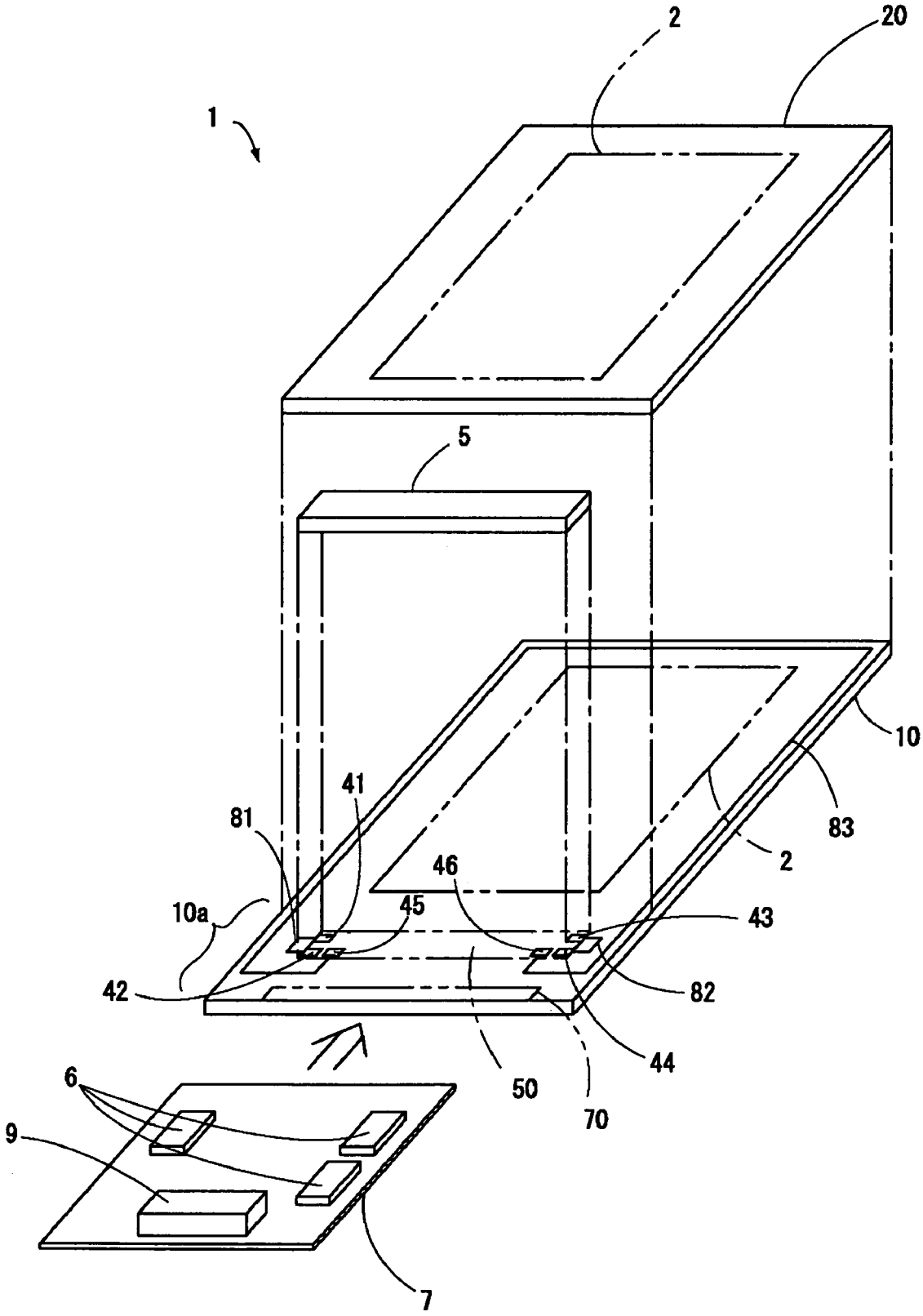
FIG. 3 is an explanatory diagram illustrating a self-diagnostic structure among various components of an electro-optical device according to a first embodiment of the invention.
Figure 4:
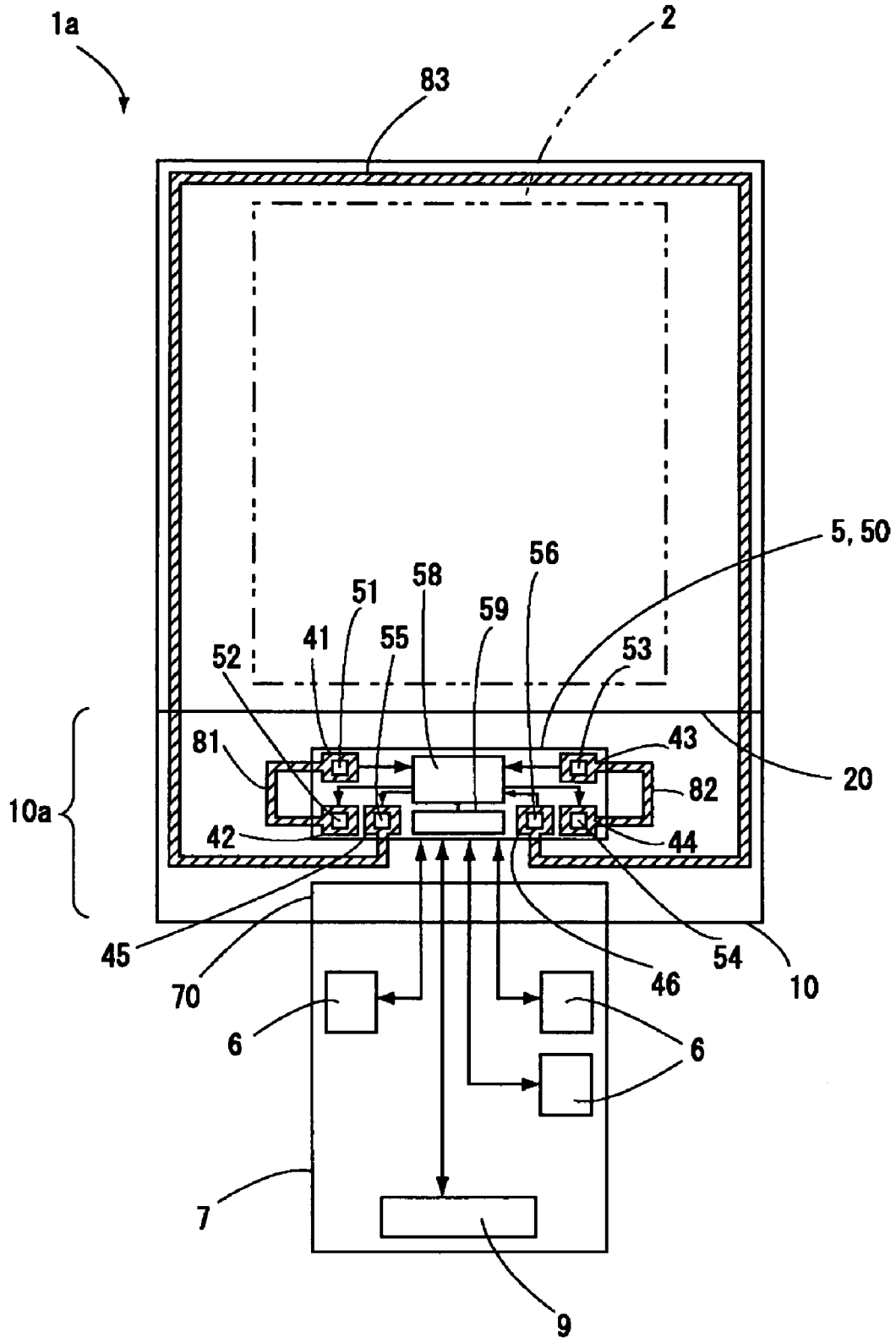
FIG. 4 is a plan view illustrating the self-diagnostic structure among various components of the electro-optical device according to the first embodiment of the invention.

FIGS. 3 and 4 are explanatory diagrams illustrating a self-diagnostic structure among various components of the electro-optical device according to the present embodiment.

Referring to FIGS. 3 and 4, in the electro-optical device 1*a*, the driving IC 5 has a plurality of bumps (first terminals), and a plurality of pads (second terminals) are provided in the IC mounting region of the element substrate 10. In addition, the bumps of the driving IC 5 are respectively connected to the pads of the element substrate 10 through an anisotropic conductive material by, for example, a pressing method.

In the present embodiment, among the plurality of bumps of the driving IC 5, bumps 51, 52, 53, and 54 positioned at both ends of an active surface (a surface formed with terminals) thereof are used for diagnosing electrical connection between the bumps of the driving IC and the pads of the element substrate 10. In addition, the bumps 51 and 52 constitute a pair of first connection state diagnostic terminals, and the bumps 53 and 54 constitute another pair of first connection state diagnostic terminals.

On the other side, among the plurality of pads formed on the element substrate 10, pads 41 and 42 connected to the pair of first connection state diagnostic terminals composed of the bumps 51 and 52 constitute a pair of second connection state diagnostic terminals, and pads 43 and 44 connected to the pair of first connection state diagnostic terminals composed of the bumps 53 and 54 constitute another pair of second connection state diagnostic terminals. In addition, the pads 41 and 42 are connected to each other by a connection state diagnostic conductive pattern 81 formed on the element substrate 10, and the pads 43 and 44 are connected to each other by a connection state diagnostic conductive pattern 82 formed on the element substrate 10. These connection state diagnostic conductive patterns 81 and 82 are simultaneously formed with the data lines 52*a*.

Further, a diagnostic unit 58 is formed in the driving IC 5, and the diagnostic unit 58, serving as a connection state diagnostic unit, outputs predetermined signals to the bumps 52 and 54 and receives signals from the bumps 51 and 53. Therefore, when good connection (pressing) is obtained both between the bump 51 and the pad 41 and between the bump 52 and the pad 42, the signal output from the diagnostic unit 58 to the bump 52 is input to the diagnostic unit 58 as it is, via the pad 42, the connection state diagnostic conductive pattern 81, the pad 41, and the bump 51. On the other hand, when poor connection is obtained between the bump 51 and the pad 41 or between the bump 52 and the pad 42, the signal output from the diagnostic unit 58 to the bump 52 is not input from the bump 51 to the diagnostic unit 58. Similarly, when good connection is obtained both between the bump 53 and the pad 43 and between the bump 54 and the pad 44, the signal output from the diagnostic unit 58 to the bump 54 is input to the diagnostic unit 58 as it is, via the pad 44, the connection state diagnostic conductive pattern 82, the pad 43, and the bump 53. On the contrary, when poor connection is obtained between the bump 53 and the pad 43 or between the bump 54 and the pad 44, the signal output from the diagnostic unit 58 to the bump 54 is not input from the bump 53 to the diagnostic unit 58.

In this way, the diagnostic unit 58 can diagnose the connection state between the bumps and the pads, and a diagnosis result output unit 59, serving as a connection state diagnosis result output unit, can output the diagnosis result to the outside through the connector 9 of the flexible substrate 7. In addition, the diagnostic unit 58 can output the diagnosis result for the connection state between the bumps and the pads to the data lines 52*a* to display it on the image display region 2. Thus, when a defect occurs in the electro-optical device 1*a*, it is possible to easily determine whether the defect is caused by the mounting of the driving IC 5 on the element substrate 10.

Further, in the present embodiment, since the bumps 51, 52, 53, and 54, serving as first connection state diagnostic terminals, are respectively formed at four corners of the active surface of the driving IC 5, it is possible to reliably diagnose the connection state of the driving IC 5 to the element substrate 10. That is, when the driving IC 5 is mounted, defects can easily occur at both ends thereof. Therefore, if two pairs of first connection state diagnostic terminals (the bumps 51, 52, 53, and 54) are respectively arranged at both ends of the active surface, it is possible to reliably diagnose the mounting state of the driving IC 5 on the element substrate 10. In addition, in the present embodiment, the connection state diagnostic terminals are provided at both ends of the active surface. However, they may be provided at one end. Further, one of the bumps 51, 52, 53, and 54 may be provided as the first connection state diagnostic terminal, and one of the pads 41, 42, 43, and 44 may be provided as the second connection state diagnostic terminal on the element substrate 10. In addition, the connection state diagnostic conductive pattern may not be connected to the second connection state diagnostic terminal. In this case, for example, a predetermined potential is applied from the first connection state diagnostic terminal to the second connection state diagnostic terminal. At that time, when they are electrically connected to each other, the potential varies therebetween. Therefore, if the potential does not vary, it is possible to determine that the terminals are not electrically connected to each other.

Furthermore, the diagnosis result for the connection state can be informed, for example, in the form of the lighting of a predetermined lamp. In addition, the diagnosis of the connection state can be performed by the instruction (operation) of a user, or a self-diagnosis thereof can be automatically performed at regular intervals.

Structure of Substrate Crack Diagnostic Function

In the electro-optical device 1*a* of the present embodiment, since a glass substrate is used as the element substrate 10, the element substrate 10 may be cracked by an external impact during or after manufacture. Therefore, in the present embodiment, as described below, it is possible to self-diagnose whether a crack occurs in the element substrate 10.

That is, in the electro-optical device 1*a* of the present embodiment, first, among the plurality of bumps of the driving IC 5, bumps 55 and 56 positioned at both ends of the active surface (the surface formed with terminals) function to diagnose the crack of the element substrate 10, and constitute a pair of first substrate crack diagnostic terminals.

On the other hand, among the plurality of pads formed on the element substrate 10, pads 45 and 46 connected to the pair of first substrate crack diagnostic terminals composed of the bumps 55 and 56 constitute a pair of second substrate crack diagnostic terminals. In addition, the pads 45 and 46 are connected to each other by a thin substrate crack diagnostic conductive pattern 83 formed along the outer periphery of the element substrate 10. This substrate crack diagnostic conductive pattern 83 is simultaneously formed with the data lines 52*a*.

Further, the diagnostic unit 58 of the driving IC 5, serving as a substrate crack diagnostic unit, outputs a predetermined signal to the bump 55 and receives a signal from the bump 56. Therefore, when no crack occurs in the element substrate 10, so that the substrate crack diagnostic conductive pattern 83 is not broken, the signal output from the diagnostic unit 58 to the bump 55 is input to the diagnostic unit 58 as it is, via the pad 45, the substrate crack diagnostic conductive pattern 83, the pad 46, and the bump 56. On the other hand, when a crack occurs in the element substrate 10, so that the substrate crack diagnostic conductive pattern 83 is broken, the signal output from the diagnostic unit 58 to the bump 55 is not input from the bump 56 to the diagnostic unit 58.

In this way, the diagnostic unit 58 can determine whether a crack occurs in the element substrate 10, based on whether the substrate crack diagnostic conductive pattern 83 is broken, and the diagnosis result output unit 59, serving as a substrate crack diagnosis result output unit, can output the diagnosis result to the outside through the connector 9 of the flexible substrate 7. In addition, the diagnostic unit 58 can output the diagnosis result for the substrate crack to the data lines 52*a* to display it on the image display region 2. Thus, when a defect occurs in the electro-optical device 1*a*, it is possible to easily determine whether the data lines 52*a* and the scanning lines 51*a* are broken due to the crack of the element substrate 10.

Furthermore, the diagnosis result for the substrate crack can be informed, for example, in the form of the lighting of a predetermined lamp. In addition, the diagnosis of the substrate crack can be performed by the instruction (operation) of a user, or a self-diagnosis thereof can be automatically performed at regular intervals.

Structure of Self-Diagnostic Function of IC

In the electro-optical device 1*a* of the present embodiment, the element substrate 10 has the driving IC 5 mounted thereon, and the flexible substrate 7 has a plurality of auxiliary ICs 6, such as a power supply IC, an EPROM, and an IC for driving an LED for a backlight, mounted thereon.

Here, the driving IC 5 is provided with the diagnostic unit 58 and the diagnosis result output unit 59. In the present embodiment, when a command for allowing the driving IC 5 to diagnose the ICs 6 is input from the outside to the driving IC 5 through the connector 9 of the flexible substrate 7, the diagnostic unit 58 of the driving IC 5 outputs a command signal to the respective auxiliary ICs 6 to allow information on the normal operations of the respective auxiliary ICs 6, such as a current operation state and an operation history until now, to be input to the driving IC 5. As a result, the auxiliary ICs 6 output signals related to their operations to the driving IC 5, and then the diagnostic unit 58 of the driving IC 5 can output the information or the diagnosis results of the auxiliary ICs 6 based on this information, and information on a normal operation of the driving IC 5, such as a current operation state and an operation history thereof until now, or the diagnosis result for the driving IC 5 based on these information items, from the diagnosis result output unit 59 to the outside through the connector 9 of the flexible substrate 7. In addition, the diagnostic unit 58 can output information on the auxiliary ICs 6 to the data lines 52*a* to display it on the image display region 2. Thus, when a defect occurs in the electro-optical device 1*a*, it is possible to easily determine whether the defect is caused by the auxiliary ICs 6.

Further, even if a plurality of auxiliary ICs 6 is mounted, it is not necessary to provide a self-diagnostic function for each of the plurality of auxiliary ICs 6 and to output the diagnosis result to each of the plurality of auxiliary ICs 6. Therefore, it is possible to perform the diagnosis of the plurality of ICs 5 and 6 with a simple circuit structure. In addition, signal transmission between the outside and the driving IC 5 can be performed using, for example, data buses, which have been used in the related art, and signal transmission between the driving IC 5 and the auxiliary ICs 6 can be performed using, for example, signal lines, which have been used in the related art. Thus, there is an advantage in that a large change in design is not needed.

Furthermore, the diagnosis results of the ICs can be informed, for example, in the form of the lighting of a predetermined lamp. In addition, the self-diagnosis of the ICs can be performed by the instruction (operation) of a user, or can be automatically performed at regular intervals.

Second Embodiment

Figure 5:
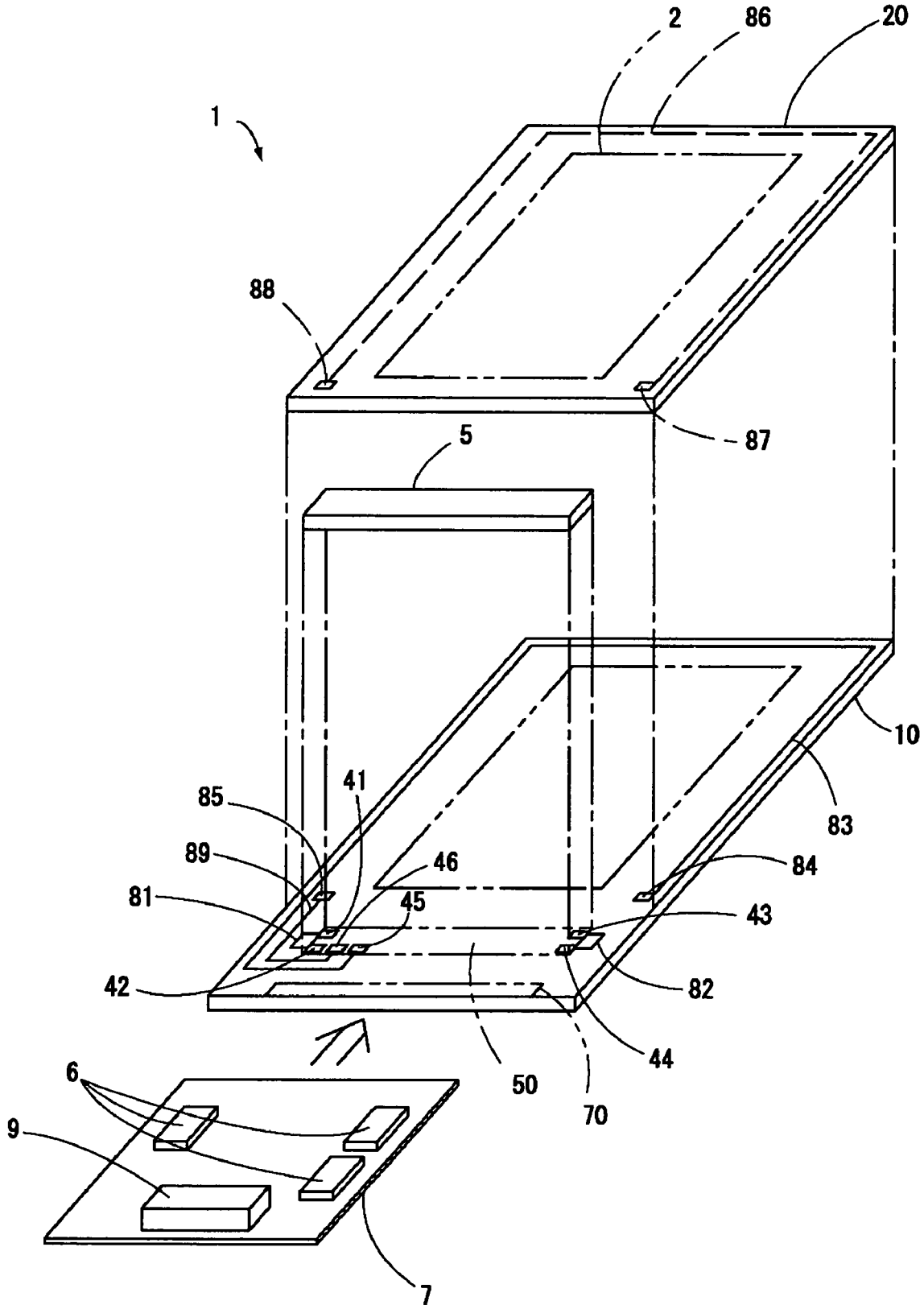
FIG. 5 is an explanatory diagram illustrating a self-diagnostic structure among various components of an electro-optical device according to a second embodiment of the invention.

FIG. 5 is an explanatory diagram illustrating a self-diagnostic structure among various components of an electro-optical device according to a second embodiment of the invention. Since the electro-optical device of the second embodiment has the same basic structure as that in the first embodiment, components having the same functions as those in the first embodiment have the same reference numerals, and thus the description thereof will be omitted.

In the electro-optical device 1*a* shown in FIG. 5, as described in the first embodiment, the element substrate 10, which is the first substrate, and the counter substrate 20, which is the second substrate, are bonded to each other with an intersubstrate conductive material interposed therebetween, so that the intersubstrate connecting terminals are electrically connected to each other. In the present embodiment, of the element substrate 10 and the counter substrate 20, the driving IC 5 and the flexible substrate 7 are mounted on only the element substrate 10, and the pads 45 and 46, serving as a pair of second substrate crack diagnostic terminals, are formed thereon. However, this structure also makes it possible to diagnose the crack of the counter substrate 20.

That is, the pads 45 and 46, serving as a pair of second substrate crack diagnostic terminals, are formed adjacent to each other on the element substrate 10.

In addition, the substrate crack diagnostic conductive pattern 83 is formed on the element substrate 10 along an outer periphery thereof such that one end of the pattern is connected to the pad 45 and the other end thereof functions as an intersubstrate connecting terminal 85. Further, a substrate crack diagnostic conductive pattern 89 for relay is formed on the element substrate such that one end thereof is connected to the pad 46 and the other end serves as an intersubstrate connecting terminal 85.

On the other hand, a substrate crack diagnostic conductive pattern 86 is also formed on the counter substrate 20 along an outer periphery thereof. Here, one end of the substrate crack diagnostic conductive pattern 86 functions as an intersubstrate connecting terminal 87 at a position overlapping the intersubstrate connecting terminal 84 of the element substrate 10 in plan view, and the other end thereof serves as an intersubstrate connecting terminal 88 at a position overlapping the intersubstrate connecting terminal 85 of the element substrate 10 in plan view.

Accordingly, when the element substrate 10 and the counter substrate 20 are bonded to each other with the intersubstrate conductive material interposed therebetween, the intersubstrate connecting terminals 87 and 88 of the counter substrate 20 are electrically connected to the intersubstrate connecting terminals 84 and 85 of the element substrate 10, respectively. As a result, the substrate crack diagnostic conductive pads 83 and 86 are electrically connected to each other in series between the pads 45 and 46 serving as a pair of second substrate crack diagnostic terminals.

Therefore, as described in the first embodiment, the diagnostic unit 58 of the driving IC 5, serving as a substrate crack diagnostic unit, outputs a predetermined signal to the bump 55. At that time, when no crack occurs in the element substrate 10 and the counter substrate 20, so that either of the substrate crack diagnostic conductive patterns 83 and 86 is not broken, the signal output from the diagnostic unit 58 to the bump 55 is input to the diagnostic unit 58 as it is, via the pad 45, the substrate crack diagnostic conductive pattern 83, the intersubstrate connecting terminals 84 and 87, the substrate crack diagnostic conductive pattern 86, the intersubstrate connecting terminals 88 and 85, the substrate crack diagnostic conductive pattern 89, the pad 46, and the bump 56. On the other hand, when a crack occurs in the element substrate 10 or the counter substrate 20, so that the substrate crack diagnostic conductive pattern 83 or 86 is broken, the signal output from the diagnostic unit 58 to the bump 55 is not input from the bump 56 to the diagnostic unit 58. In this way, the diagnostic unit 58 can determine whether a crack occurs in the element substrate 10 or the counter substrate 20, based on whether the substrate crack diagnostic conductive patterns 83 and 86 are broken, and the diagnosis result output unit 59, serving as a substrate crack diagnosis result output unit, can output the diagnosis result to the outside through the connector 9 of the flexible substrate 7. In addition, the diagnostic unit 58 can output the diagnosis result for the substrate crack to the data lines 52*a* to display it on the image display region 2. Thus, when a defect occurs in the electro-optical device 1*a*, it is possible to easily determine whether the data lines 52*a* or the scanning lines 51*a* are broken due to the crack of the element substrate 10 or the counter substrate 20. In addition, since the other structures of this embodiment are the same as those in the first embodiment, the description thereof will be omitted.

Third Embodiment

Figure 6:
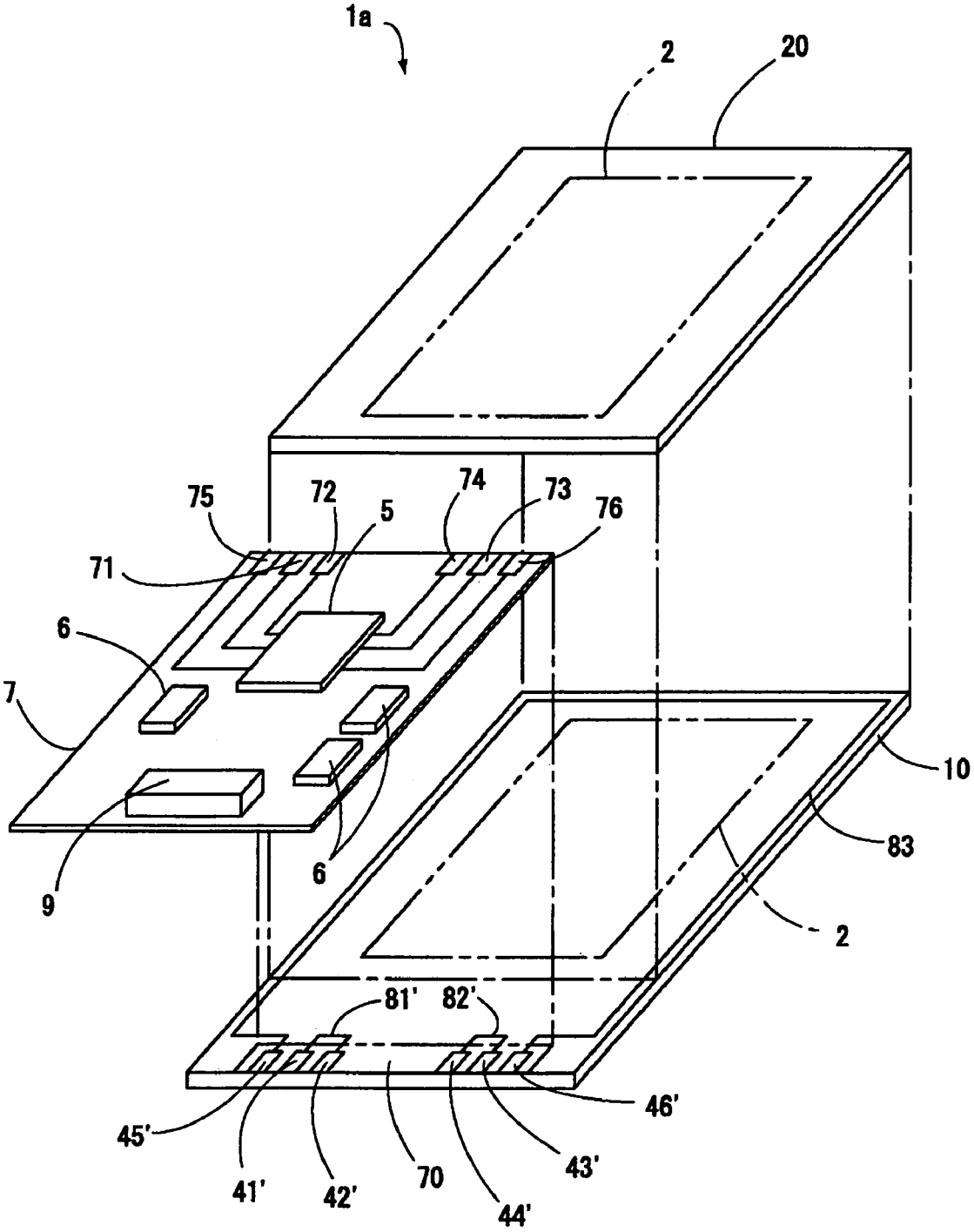
FIG. 6 is an explanatory diagram illustrating a self-diagnostic structure among various components of an electro-optical device according to a third embodiment of the invention.

FIG. 6 is an explanatory diagram illustrating a self-diagnostic structure among various components of an electro-optical device according to a third embodiment of the invention. In the first and second embodiments, the driving IC 5 is mounted on the element substrate 10 in a COG manner. However, in the present embodiment, the driving IC 5 is mounted on the flexible substrate 7 in a COF manner. Here, since the electro-optical device of the third embodiment has the same basic structure as that in the first embodiment, components having the same functions as those in the first embodiment have the same reference numerals, and thus the description thereof will be omitted.

As shown in FIG. 6, in the electro-optical device 1*a* of the present embodiment, the element substrate 10 is mounted with the flexible substrate 7 (the wiring substrate) having the driving IC 5 (the first IC), the auxiliary ICs 6 (the second ICs), and the connector 9 thereon. Therefore, a plurality of mounting terminals (first terminals) for mounting the flexible substrate 7 on the element substrate 10 is provided on the flexible substrate 7, and a plurality of pads (second terminals) for electrical connection between the element substrate 10 and the flexible substrate 7 is formed in a substrate connecting region 70 of the element substrate 10.

In the present embodiment, among a plurality of terminals of the flexible substrate 7, terminals 71, 72, 73, and 74 positioned at both ends thereof are used for diagnosing electrical connection between the terminals of the flexible substrate 7 and the pads of the element substrate 10. In addition, the terminals 71 and 72 constitute a pair of first connection state diagnostic terminals, and the terminals 73 and 74 constitute another pair of first connection state diagnostic terminals.

On the other side, among a plurality of pads formed on the element substrate 10, pads 41' and 42', connected to the pair of first connection state diagnostic terminals composed of the terminals 71 and 72 constitute a pair of second connection state diagnostic terminals, and pads 43' and 44' connected to the pair of first connection state diagnostic terminals composed of the terminals 73 and 74 constitute another pair of second connection state diagnostic terminals. In addition, the pads 41' and 42' are connected to each other by a connection state diagnostic conductive pattern 81' formed on the element substrate 10, and the pads 43' and 44' are connected to each other by a connection state diagnostic conductive pattern 82' formed on the element substrate 10. These connection state diagnostic conductive patterns 81' and 82' are simultaneously formed with the data lines 52*a*.

Further, similar to the first embodiment, the diagnostic unit 58 is provided in the driving IC 5, and the diagnostic unit 58, serving as a connection state diagnostic unit, outputs predetermined signals to the terminals 72 and 74 and receives signals from the terminals 71 and 73. Therefore, when good connection is obtained both between the terminal 71 and the pad 41' and between the terminal 72 and the pad 42', the signal output from the diagnostic unit 58 to the terminal 72 is input to the diagnostic unit 58 as it is, via the pad 42', the connection state diagnostic conductive pattern 81', the pad 41', and the terminal 71. On the other hand, when poor connection is obtained between the terminal 71 and the pad 41' or between the terminal 72 and the pad 42', the signal output from the diagnostic unit 58 to the terminal 72 is not input from the terminal 71 to the diagnostic unit 58. Similarly, when good connection is obtained both between the terminal 73 and the pad 43' and between the terminal 74 and the pad 44', the signal output from the diagnostic unit 58 to the terminal 74 is input to the diagnostic unit 58 as it is, via the pad 44', the connection state diagnostic conductive pattern 82', the pad 43', and the terminal 73. On the contrary, when poor connection is obtained between the terminal 73 and the pad 43' or between the terminal 74 and the pad 44', the signal output from the diagnostic unit 58 to the terminal 74 is not input from the terminal 73 to the diagnostic unit 58.

In this way, the diagnostic unit 58 can diagnose the connection state between the terminals and the pads, and the diagnosis result output unit 59, serving as a connection state diagnosis result output unit, can output the diagnosis result to the outside through the connector 9 of the flexible substrate 7. In addition, the diagnostic unit 58 can output the diagnosis result for the connection state between the terminals and the pads to the data lines 52*a* to display it on the image display region 2. Thus, when a defect occurs in the electro-optical device 1*a*, it is possible to easily determine whether the defect is caused by the mounting of the flexible substrate 7 on the element substrate 10. In addition, the forming positions of the terminals 71, 72, 73, and 74 (two pairs of first connection state diagnostic terminals) on the flexible substrate 7 is not limited to both ends thereof, but the terminals may be formed at a central region of the flexible substrate 7 in the lengthwise direction thereof by a pressing method.

In the electro-optical device 1*a* having the above-mentioned structure, it is also possible to determine whether a crack occurs in the element substrate 10 in a self-diagnostic manner. That is, in the electro-optical device 1*a* of the present embodiment, among a plurality of terminals of the flexible substrate 7, terminals 75 and 76 positioned at both ends thereof are used for diagnosing the crack of the element substrate 10, and constitute a pair of first substrate crack diagnostic terminals.

On the other side, among a plurality of pads formed on the element substrate 10, pads 45' and 46' connected to the pair of first substrate crack diagnostic terminals composed of the terminals 75 and 76 constitute a pair of second substrate crack diagnostic terminals. In addition, the pads 45' and 46' are connected to each other by the thin substrate crack diagnostic conductive pattern 83 formed along the outer periphery of the element substrate 10. This substrate crack diagnostic conductive pattern 83 is simultaneously formed with the data lines 52*a*.

Further, similar to the first embodiment, the diagnostic unit 58 of the driving IC 5, serving as a substrate crack diagnostic unit, outputs a predetermined signal to the terminal 75 and receives a signal from the terminal 76. Therefore, when no crack occurs in the element substrate 10, so that the substrate crack diagnostic conductive pattern 83 is not broken, the signal output from the diagnostic unit 58 to the terminal 75 is input to the diagnostic unit 58 as it is, via the pad 45', the substrate crack diagnostic conductive pattern 83, the pad 46', and the terminal 76. On the other hand, when a crack occurs in the element substrate 10, so that the substrate crack diagnostic conductive pattern 83 is broken, the signal output from the diagnostic unit 58 to the terminal 75 is not input from the terminal 76 to the diagnostic unit 58.

In this way, the diagnostic unit 58 can determine whether a crack occurs in the element substrate 10, based on whether the substrate crack diagnostic conductive pattern 83 is broken, and the diagnosis result output unit 59, serving as a substrate crack diagnosis result output unit, can output the diagnosis result to the outside through the connector 9 of the flexible substrate 7. In addition, the diagnostic unit 58 can output the diagnosis result for the substrate crack to the data lines 52*a* to display it on the image display region 2. Thus, when a defect occurs in the electro-optical device 1*a*, it is possible to easily determine whether the data lines 52*a* and the scanning lines 51*a* are broken due to the crack of the element substrate 10.

Further, in the electro-optical device 1*a* of the present embodiment, it is also possible to diagnose whether a crack occurs in the element substrate 10 in a self-diagnostic manner, similar to the first embodiment. Further, one of the terminals 71, 72, 73, and 74 may be provided as the first connection state diagnostic terminal, and one of the pads 41', 42', 43', and 44' may be provided as the second connection state diagnostic terminal on the element substrate 10. In addition, the connection state diagnostic conductive pattern may not be connected to the second connection state diagnostic terminal. In this case, for example, a predetermined potential is applied from the first connection state diagnostic terminal to the second connection state diagnostic terminal. At that time, when they are electrically connected to each other, the potential varies therebetween. Therefore, if the potential does not vary, it is possible to determine that the terminals are not electrically connected to each other.

OTHER EMBODIMENTS

In the first embodiment, the driving IC 5 and the flexible substrate 7 are connected to the element substrate 10 or the counter substrate 20. However, in a case in which the driving IC and the flexible substrate are connected to both the element substrate 10 and the counter substrate 20, the invention may be applied to both the element substrate 10 and the counter substrate 20.

Further, in the above-mentioned embodiments, the invention is applied to an active matrix liquid crystal device, but may be applied to a passive matrix liquid crystal device. In addition, in the above-mentioned embodiments, the invention is applied to a transmissive active matrix liquid crystal device, but may be applied to a reflective or transflective active matrix liquid crystal device. Further, the invention may be applied to the following electro-optical devices shown in FIGS. 7 and 8.

Figure 7:
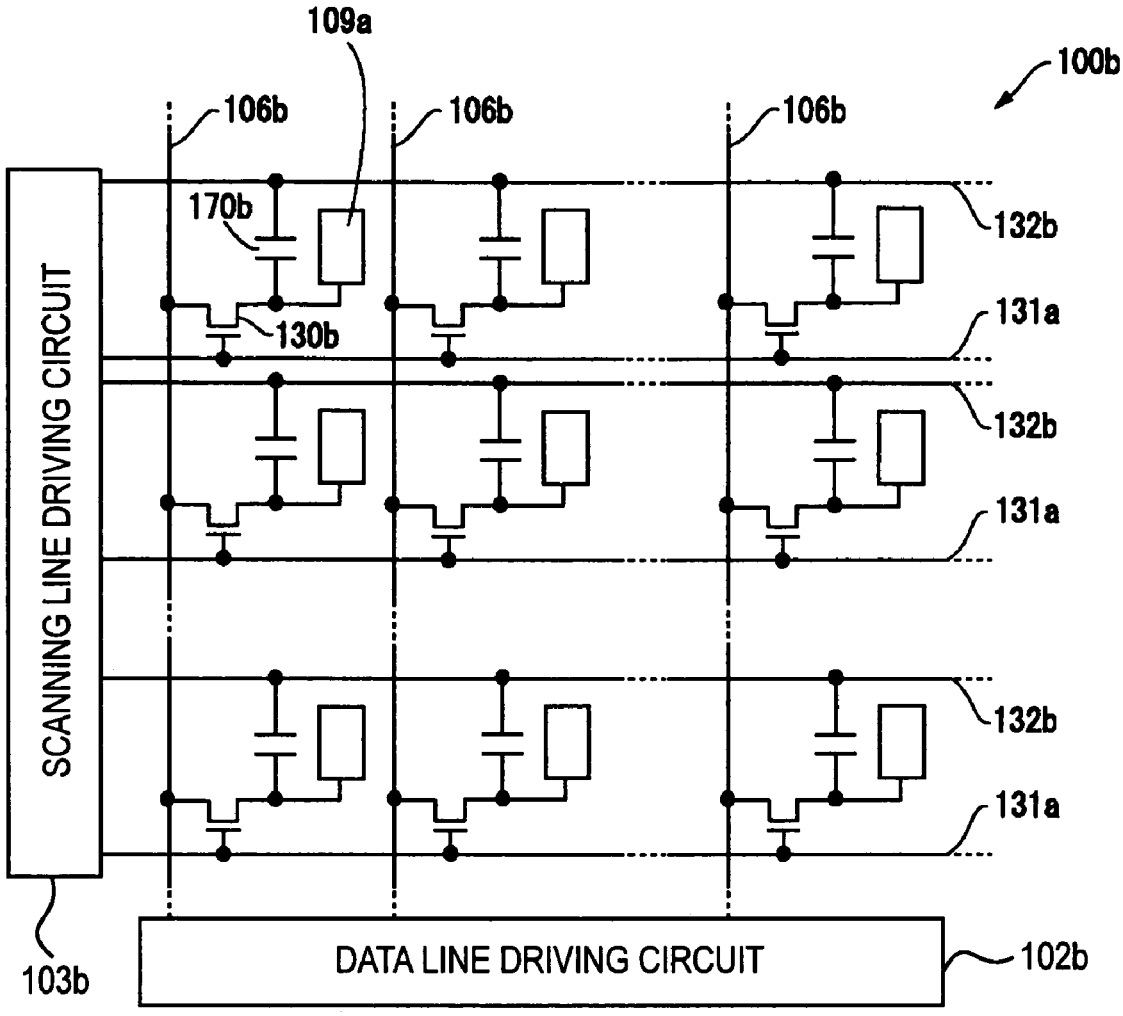
FIG. 7 is a block diagram schematically illustrating the structure of an electro-optical device composed of an active matrix liquid crystal device using thin film transistors (TFTS) as pixel switching elements.
Figure 8:
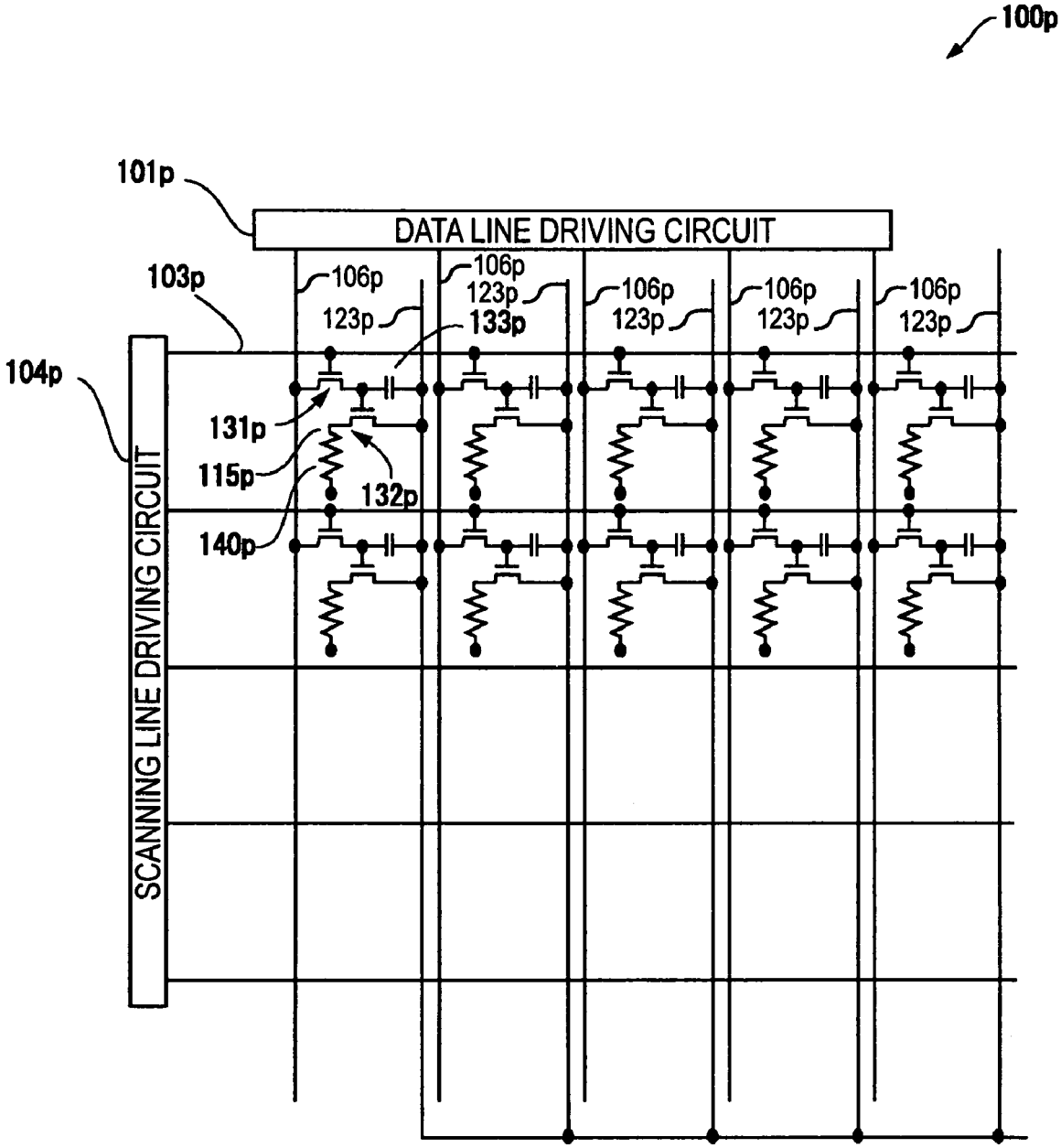
FIG. 8 is a block diagram illustrating an active matrix liquid crystal device having electroluminescent elements in which a charge-injection-type organic thin film is used as an electro-optical material.

FIG. 7 is a block diagram schematically illustrating the structure of an electro-optical device composed of an active matrix liquid crystal device using thin film transistors (TFTs) as pixel switching elements. FIG. 8 is a block diagram schematically illustrating the structure of an active matrix electro-optical device provided with electroluminescent elements in which a charge-injection-type organic thin film is used as an electro-optical material.

As shown in FIG. 7, in an electro-optical device 100*b* composed of an active matrix liquid crystal device using TFTs as pixel switching elements, each pixel arranged in a matrix is provided with a pixel switching TFT 130*b* for controlling a pixel electrode 109*b*, and each data line 106*b* for supplying image signals is electrically connected to a source of the TFT 130*b*. The image signals to be written on the data lines 106*b* are supplied from a data line driving circuit 102*b*. In addition, each scanning line 131*b* is electrically connected to a gate of the TFT 130*b*, and scanning signals are supplied in pulse from a scanning line driving circuit 103*b* to the scanning lines 131*b* at a predetermined timing. The pixel electrodes 109*b* are electrically connected to drains of the TFTs 130, and the image signals supplied from the data lines 106*b* are written on the respective pixels at a predetermined timing by keeping the TFTs 130*b*, serving as switching elements, an on state for a predetermined period. Sub-pixel signals having predetermined levels that have been written on liquid crystal through the pixel electrodes 109*b* are held between the pixel electrodes and a counter electrode formed on the counter substrate (not shown) for a predetermined period. Here, in order to prevent the held pixel signals from leaking, storage capacitors 170*b* are additionally provided parallel to liquid crystal capacitance formed between the pixel electrodes 109*b* and the counter electrode. The storage capacitor 170*b* holds the voltage of the pixel electrode 109*b* for a longer time than the time when a source voltage is applied by, for example, a three-digit number. In this way, it is possible to improve charge holding characteristics, and thus to realize an electro-optical device capable of displaying an image with a high contrast ratio. In addition, the storage capacitor 170*b* may be formed between the pixel electrode and a capacitor line 132*b*, which is a wiring line for forming capacitance, or may be formed between the pixel electrode and the scanning line 131*b* in the previous stage.

In the liquid crystal device having the above-mentioned structure, a portion of or the entire data line driving circuit 102*b* or scanning line driving circuit 103*b* may be provided in an IC mounted on an electro-optical device substrate in a COG or COF manner. Therefore, the invention can be applied to the mounting of an IC. In addition, in this liquid crystal device, since various components are formed on, for example, a glass substrate, the substrate crack diagnostic structure according to the invention can also be applied to the liquid crystal device.

As shown in FIG. 8, an active matrix electro-optical device 100*p* provided with electroluminescent elements using the charge-injection-type organic thin film is an active matrix display device in which the driving of light-emitting elements, such as light-emitting diodes (LEDs) or electroluminescent (EL) elements that emit light when a driving current flows through an organic semiconductor film, is controlled by TFTs. In addition, since the light-emitting elements used for this type of display device are self-emitting elements, the display device has advantages in that a backlight is not needed and the viewing angel dependence thereof is low.

The electro-optical device 100*p* shown in FIG. 8 includes a plurality of scanning lines 103*p*, a plurality of data lines 106*p* extending in a direction orthogonal to the plurality of scanning lines 103*p*, a plurality of common feeder lines 123*p* extending parallel to the data lines 106*p*, and pixels 115*p* provided corresponding to intersections of the data lines 106*p* and the scanning lines 103*p*. The data lines 106*p* are connected to a data line driving circuit 101*p* including a shift register, a level shifter, video lines, and analog switches. The scanning lines 103*p* are connected to a scanning line driving circuit 104*p* including a shift register and a level shifter. In addition, each pixel 115*p* is provided with a first TFT 131*p* whose gate electrode is supplied with a scanning signal through the scanning line 103*p*, a storage capacitor 133*p* for holding an image signal supplied from the data line 106*p* through the first TFT 131*p*, a second TFT 132*p* whose gate electrode is supplied with the image signal held in the storage capacitor 133*p*, and a light emitting element 140*p* to which a driving current flows from the common feeder line 123*p* when electrically connected to the common feeder line 123*p* via the second TFT 132*p*. The light emitting element 140*p* is formed by laminating, on the pixel electrode, a hole injecting layer, an organic semiconductor layer, serving as an organic electroluminescent material layer, and a counter electrode made of a metallic material, such as calcium or aluminum containing lithium, in this order. The counter electrode is formed on the data lines 106*p* so as to place across the plurality of pixels 115*p*.

In the electroluminescent-type electro-optical device having the above-mentioned structure, a portion of or the entire data line driving circuit 101*p* or scanning line driving circuit 104*p* may be provided in an IC mounted on an electro-optical device substrate in a COG or COF manner. Therefore, the invention may be applied to the mounting of an IC. In addition, in such an electroluminescent-type electro-optical device, since various components are formed on, for example, a glass substrate, the substrate crack diagnostic structure according to the invention can also be applied thereto.

Further, in addition to the electro-optical devices described in the above-mentioned embodiments, the invention can be applied to various electro-optical devices, such as a plasma display device, a field emission display (FED) device, a light emitting diode (LED) display device, an electrophoresis display device, a thin cathode-ray tube, a small television using a liquid crystal shutter, and devices using a digital micromirror device (DMD).

The above-mentioned electro-optical device can be used for portable electronic apparatuses, such as a cellular phone and a mobile computer, or for electronic apparatuses having, for example, a direct-view-type display device or a projection display device.

What is claimed is:

1. An electro-optical device comprising:

a first substrate;

a first IC that has a plurality of first terminals and that is mounted on the first substrate;

a plurality of second terminals that are formed on the first substrate to be connected to the first terminals;

a plurality of wiring lines formed on the first substrate;

a pair of first connection state diagnostic terminals that is included in the first terminals of the first IC and that is used for diagnosing connection state between the first terminals and the second terminals;

a pair of second connection state diagnostic terminals that is included in the second terminals on the first substrate and that is connected to the air of first connection state diagnostic terminals, the pair of second connection state diagnostic terminals being electrically connected together by one of the wiring lines;

a connection state diagnostic unit that is provided in the first IC and that outputs a signal to one of the first pair of first connection state diagnostic terminals, and receives input of the signal from the other of the pair of first connection state diagnostic terminals that was transmitted through the pair of second connection state diagnostic terminals and the one of the wiring lines to diagnose whether the pair of first connection state diagnostic terminals are electrically connected to the pair of second connection state diagnostic terminals; and a connection state diagnosis result output unit that is provided in the first IC and that outputs a diagnosis result diagnosed by the connection state diagnostic unit.

2. The electro-optical device according to claim 1, further comprising other first connection state diagnostic terminals, wherein the first IC has a rectangular shape, and the pair of first connection state diagnostic terminals and the other first connection state diagnostic terminals are provided at four corners of the first IC.

3. The electro-optical device according to claim 1, wherein the first terminals include a pair of first-substrate crack diagnostic terminals used for diagnosing whether a crack occurs in the first substrate, the second terminals include a pair of second-substrate crack diagnostic terminals connected to the pair of first-substrate crack diagnostic terminals, each of the pair of second-substrate crack diagnostic terminals are connected to a substrate crack diagnostic conductive pattern extending around an outer periphery of the first substrate, and the first IC includes a substrate crack diagnostic unit that diagnoses whether the pair of first-substrate crack diagnostic terminals are electrically connected to each other and a substrate crack diagnosis result output unit that outputs a diagnosis result diagnosed by the substrate crack diagnostic unit.

4. The electro-optical device according to claim 3, further comprising a second substrate opposite to the first substrate with an electro-optical material interposed therebetween.

5. The electro-optical device according to claim 4, further comprising another substrate crack diagnostic conductive pattern formed on the second substrate, wherein each of the first and second substrates have intersubstrate connecting terminals, the first and second substrates are bonded to each other with an intersubstrate conductive material interposed therebetween, the intersubstrate connecting terminals formed on the first and second substrates are electrically connected to each other by the intersubstrate conductive material, and the substrate crack diagnostic conductive pattern formed on the first substrate and the other substrate crack diagnostic conductive pattern formed on the second substrate are electrically connected to each other between the pair of second-substrate crack diagnostic terminals by the intersubstrate conductive material and the intersubstrate connecting terminals.

6. The electro-optical device according to claim 4, wherein a second IC is mounted on the first substrate or the second substrate, information as to whether the second IC can be normally operated is input from the second IC to the first IC, and the information or diagnosis results for the second IC based on the information are output from the first IC.

7. An electronic apparatus comprising the electro-optical device according to claim 1.

8. A mounting structure comprising:

a first substrate;

a first IC that has a plurality of first terminals and that is mounted on the first substrate;

a plurality of second terminals formed on the first substrate to be connected to the first terminals;

a plurality of wiring lines formed on the first substrate;

a pair of first connection state diagnostic terminals that is included in the first terminals of the first IC and that is used for diagnosing connection state between the first terminals and the second terminals;

a pair of second connection state diagnostic terminals that is included in the second terminals on the first substrate and that is connected to the pair of first connection state diagnostic terminals, the pair of second connection state diagnostic terminals being electrically connected together by one of the wiring lines;

a connection state diagnostic unit that is provided in the first IC and that outputs a signal to one of the first pair of first connection state diagnostic terminals, and receives input of the signal from the other of the pair of first connection state diagnostic terminals that was transmitted through the pair of second connection state terminals and the one of the wiring lines to diagnose whether the pair of second connection state diagnostic terminals are electrically connected to each other; and a connection state diagnosis result output unit that is provided in the first IC and that outputs a diagnosis result diagnosed by the connection state diagnostic unit.

* * * * *